US005926679A

United States Patent [19]

May et al.

[11] Patent Number: 5,926,679

[45] Date of Patent: Jul. 20, 1999

[54] METHOD AND APPARATUS FOR FORMING AN IMAGE FOR TRANSFER TO A RECEIVER SHEET USING A CLEAR TONER AND SINTERING OF A PIGMENTED TONER LAYER

[75] Inventors: John W. May; Thomas N. Tombs, both of Rochester, N.Y.

[73] Assignee: Eastman Kodak Company, Rochester, N.Y.

[21] Appl. No.: 08/986,762

[22] Filed: Dec. 8, 1997

[51] Int. Cl.[6] ..... G03G 15/16

[52] U.S. Cl. ..... 399/296; 399/231; 399/297; 430/42

[58] Field of Search ..... 399/57, 220–223, 399/231, 253, 296, 298; 430/42–45

[56] References Cited

U.S. PATENT DOCUMENTS

| | | | |
|---|---|---|---|
| 4,078,929 | 3/1978 | Gundlach . | |
| 5,075,186 | 12/1991 | Sheridon . | |
| 5,102,767 | 4/1992 | Chowdry et al. . | |
| 5,104,765 | 4/1992 | Chowdry et al. . | |
| 5,110,702 | 5/1992 | Ng et al. . | |
| 5,151,717 | 9/1992 | Jamzadeh et al. | 399/385 X |
| 5,233,397 | 8/1993 | Till et al. . | |
| 5,253,021 | 10/1993 | Aslam et al. . | |
| 5,276,492 | 1/1994 | Landa et al. . | |
| 5,293,201 | 3/1994 | Kamp et al. | 399/356 |
| 5,353,105 | 10/1994 | Gundlach et al. . | |
| 5,558,970 | 9/1996 | Landa et al. . | |
| 5,559,592 | 9/1996 | Larson et al. . | |
| 5,702,852 | 12/1997 | May et al. | 430/45 X |
| 5,737,677 | 4/1998 | Tombs et al. | 399/296 |
| 5,765,081 | 6/1998 | Bogaert et al. | 399/299 |
| 5,774,159 | 6/1998 | Larson | 347/141 X |

OTHER PUBLICATIONS

'Designing Materials for the Kodak Coloredge Copier Program' published in IS&T's Sixth International Congress on Advances in Non–Impact Printing Technologies, pp. 101–110, by Edward T. Miskinis.

*Primary Examiner*—Arthur T. Grimley
*Assistant Examiner*—Quana Grainger
*Attorney, Agent, or Firm*—Norman Rushefsky

[57] ABSTRACT

An electrostatographic method and apparatus of forming a toner image on a receiver. In order to improve transfer of a pigmented toner image to a receiver, a clear toner layer is applied to a support member. The pigmented toner image is applied over the clear toner layer. The pigmented toner image is sintered and the sintered pigmented toner image is then transferred to a receiver sheet.

25 Claims, 8 Drawing Sheets

METHOD AND APPARATUS FOR FORMING AN IMAGE FOR TRANSFER TO A RECEIVER SHEET USING A CLEAR TONER AND SINTERING OF A PIGMENTED TONER LAYER

FIELD OF THE INVENTION

The present invention relates to electrostatography and more particularly to apparatus and methods for improving the electrostatic transfer of dry toner particles.

In color electrophotography, a full color image is built up by sequential transfers of individual color separation toner images. In order to maintain maximum image quality, the integrity of each color separation toner image must ideally be kept intact during each transfer. In the present state of the art, high resolution, high quality color electrophotographic prints can suffer from electrostatic transfer-induced defects, such as premature toner transfer, dot explosions, back transfer, and toner image layer disruptions. Electric field-induced changes of particle locations may occur, including both intra- and inter-layer place exchanges, especially in thick multicolor toner stacks. Image disruptions result in undesired hue shifts in a color image, as well objectionable grain and mottle.

Clear, non-marking toner underlays have been described in the prior art for example in U.S. patent application Ser. No. 08/572,559, filed in the names of Tombs et al., and now U.S. Pat. No. 5,737,677 the contents of which are incorporated herein by reference, as aids to improved transfer, especially for high quality color electrophotography. Clear toner underlays improve transfer efficiency over the whole gamut of toner layer thickness (optical density). Nevertheless, the prior art does not solve adequately the problems arising from the electrostatically induced image disruptions described above, including place exchanges between clear and color toners.

There is a need, using inexpensive and simple means, to reduce the frequency of occurrence of the above-mentioned electrostatically induced color image defects and also to improve transfer efficiency over the entire range of color toner thicknesses, especially for toner particles in direct contact with clear toner. Still other apparatus for improving transfer are described by Chowdry et al in U.S. Pat. Nos. 5,102,765 and 5,102,767. In Chowdry et al clear toner is transferred to a receiver and preferably fixed to the receiver. Thermal assisted transfer is then used to transfer a marking particle image onto the receiver which includes the clear fixed toner overlay. The role of the clear or uncolored toner layer is to serve as a thermoplastic layer so as to augment thermally assisted transfer of the marking particles.

Various other approaches for improving transfer are also known. For example, Larson et al in U.S. Pat. No. 5,559,592 discloses an apparatus and method involving sintering of liquid-developed toner deposits on a photoreceptive imaging member, whereby heating causes agglomeration of toner particles for improved transfer to an image support surface comprising a receiver such as paper, or an intermediate transfer member (ITM). Larson et al also disclose sintering of (liquid-developed) toner particles after transfer to an ITM, prior to transfer of the toner to a receiver.

Gundlach and Snelling in U.S. Pat. No. 5,353,105 describe transfer of toner to an ITM having an internal heat source for heating a portion of the ITM, whereby the toner is tackified prior to its transfer from the ITM to a receiver.

Till in U.S. Pat. No. 5,233,397 describes an apparatus for transferring a developed image from a surface to a heated ITM. The ITM is reheated to at least partially melt the toner image prior to transfer of the toner to a receiver such as paper. This invention relates primarily to liquid-developed toner.

In Aslam et al U.S. Pat. No. 5,253,021 toner is electrostatically transferred from an imaging member to a thermally conductive ITM which "is heated to a temperature sufficient to sinter the toner particles at least when they touch the intermediate and other toner particles, but insufficient to damage the image member or cause the toner to stick to the image member".

In U.S. Pat. No. 5,276,492 Landa et al describe a method and apparatus for concentrating a liquid developed image on an image member by removing carrier liquid from it, transferring the image to an ITM, heating the concentrated liquid toner image on the ITM to a temperature at which the toner particles and the carrier liquid form a single phase, and transferring the heated liquid toner image to a final substrate.

Ng and Rimai in U.S. Pat. No. 5,110,702 describe a non-electrostatic transfer process in which a developed toner image is transferred by pressure and heat to an intermediate transfer roller, the heat being sufficient to sinter the toner particles to each other. The roller is then positioned against a receiver and rolled thereover, transferring the toner image to the receiver.

There continues to exist a significant need to improve high quality electrophotographic imaging by reducing transfer-induced image defects in electrostatic transfer, especially in multicolor imaging. As may be seen from the above description, numerous approaches have been suggested yet there still exists the need to improve the release of colored toner particles from an image member or from an ITM. The present invention satisfies this need.

SUMMARY OF THE INVENTION

In the present invention, a pigmented toner image resting on a non-marking or clear toner layer is sintered by selectively absorbed radiation, the radiation preferably not being absorbed by the clear toner. The clear toner underlayer rests upon an ITM or upon a primary imaging member. Preferably, after selective radiant sintering of the color toner image, the sintered toner mass plus a portion of the underlying clear toner are co-transferred to another surface, e.g., paper.

BRIEF DESCRIPTION OF THE DRAWINGS

The subsequent description of the various exemplary embodiments of the present invention will make reference to the attached drawings wherein.

DETAILED DESCRIPTION OF THE PREFERRED EMBODIMENTS

Figure 1:
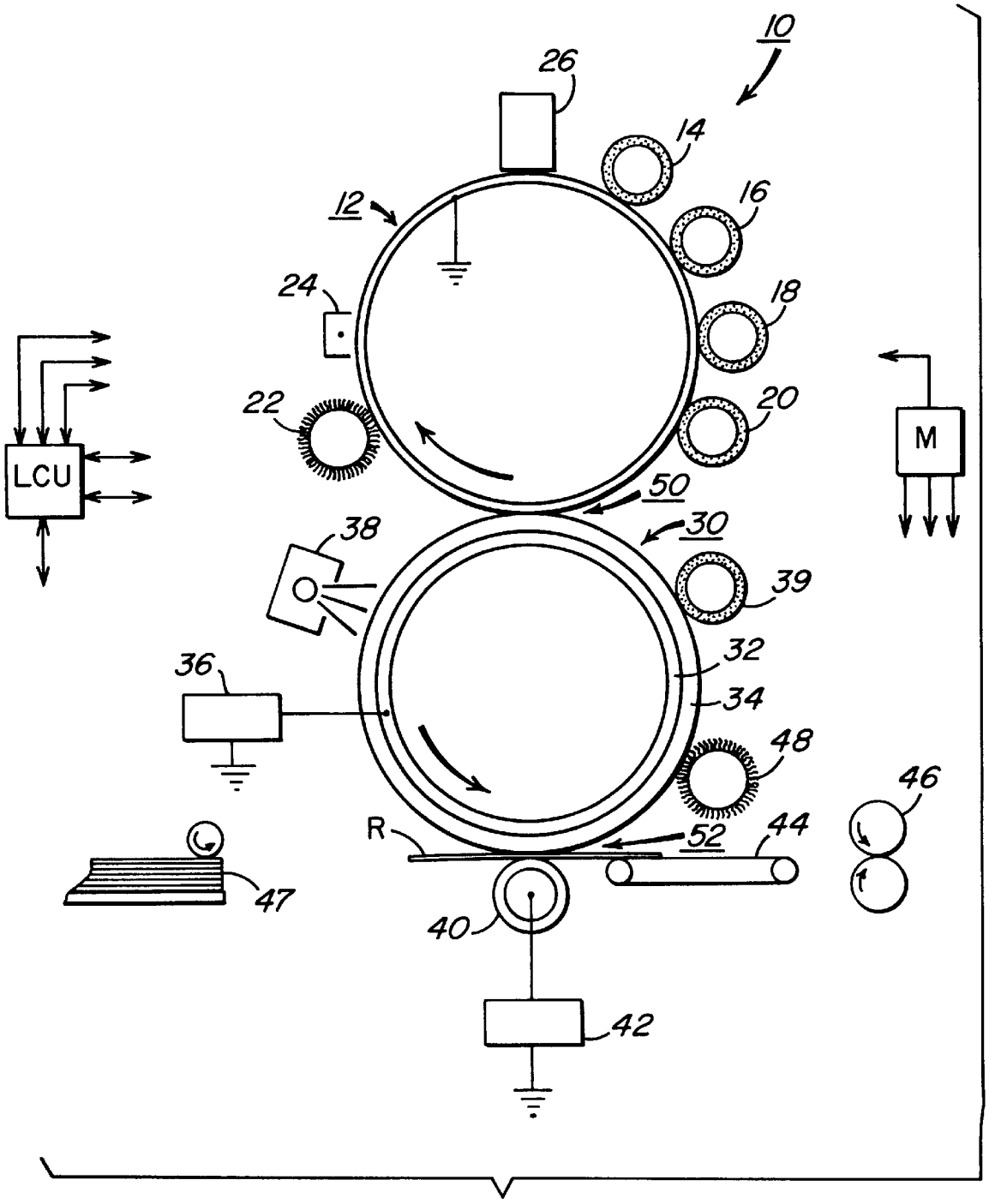
FIG. 1 is a side elevation view in schematic form of an electrophotographic recording apparatus in accordance with a first embodiment of the invention.

The description of the present invention will be directed in particular to elements forming part of or cooperating more directly with apparatus in accordance with the present invention. It is to be understood that elements not specifically shown or described may take various forms well known to those skilled in the art.

The term "primary imaging member" refers to a member onto which an electrostatic image is formed, such as, photoconductive elements, dielectric elements and electrographic masters.

The term "bias development", as used herein, means developing with charged toner particles from a development station biased with a voltage to urge the toner particles to a member, for example, an ITM or a primary imaging member. The member can also be biased with a voltage to urge the toner particles from the development station to the member.

The term "monolayer", as used herein, means a substantially full coverage of toner particles making up a single layer such that the addition of more toner particles forms a second layer of toner.

As used herein, the term "sintering" is the physical phenomenon which occurs when a mass of particles is heated to a temperature which causes the contact points between the particles to fuse. Inter-particle local pressures can be quite high in a powder, and the combination of localized pressure and heating produces the sintering. Sintering of charged toner particles on a photoconductor is aided by electrostatic inter-particle pressure created by the self-field associated with the effective volume space charge, especially in a toner multilayer. For insulating toner particles the electrostatic charge on each toner particle will not be affected by sintering. Actual melting of whole particles does not occur, and individual toner particles retain physical integrity as well as charge integrity. The material bridges between particles produced by sintering enhance inter-particle cohesion and therefore tend to reduce electrostatic transfer-induced image defects. Thus, overall transfer efficiency can be improved where the toner particles are sintered.

The term "toner size" or "toner diameter", as used herein, or the term "size", or "sized" as employed herein in reference to the term "particles", unless otherwise indicated, means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "receiver" as used herein refers to a substrate upon which a toner image is transferred and subsequently heat fused or otherwise fixed to produce a final image. Examples of suitable receivers include paper and plastic film such as films of polyethylene terephthalate, polycarbonate, or the like, which are preferably transparent and therefore useful in making transparencies. Paper is a presently preferred class of receiver, particularly smooth papers such as clay or polymer coated papers. The receiver is preferably in the form of a discrete receiver sheet.

The term "imagewise" as used herein means corresponding to a desired toner image to be produced. The term "non-imagewise" means not containing any information corresponding to a desired final toner image to be produced. Typically a non-imagewise lay-down of non-marking toner means a substantially uniform flat-field deposit.

The term "support member" may refer to a primary imaging member or to an intermediate transfer member and may be either a drum or a web.

The apparatus and method of this invention can be an electrostatographic apparatus and method in general, but are preferably a xerographic apparatus and method, and most preferably a multi-color xerographic apparatus and method.

In the apparatus and method of this invention more than one imaging member, as defined above, can be used. Typically, an apparatus for making single color final toner images has a single primary imaging member, and an apparatus for making multi-color final toner images has either one or more than one primary imaging members. In some embodiments of the invention, to make multi-color toner images, a single primary imaging member can be used to make each individual electrostatic image for each color separation and then the individual color toner images are transferred from the primary imaging member to the ITM sequentially and in registration. The method comprises forming one electrostatic image on a primary imaging member corresponding to one color in the desired toner image; toning by applying the corresponding color marking toner particles to the electrostatic image to form an individual color toner image; and transferring the individual color toner image to the surface of an ITM in the presence of an electric field which urges the individual toner image toward the ITM and repeating the forming, toning and transferring steps for each color separation in a desired toner image.

In another embodiment, a single primary imaging member is used to make the individual electrostatic images for each color separation of a desired toner image, in registration, on top of each other on the primary imaging member. In this embodiment to create a multi-color image, at least two electrostatic images are formed and toned, sequentially, in registration on the same frame of the imaging member with marking toners of at least two different colors, and then the layers of the different marking toners are transferred simultaneously to an ITM in the presence of an electric field which urges the marking toner particles toward the ITM. This method is described in Gundlach, U.S. Pat. No. 4,078,929, incorporated herein by reference.

Alternatively, more than one primary imaging member can be present in an apparatus to simultaneously form electrostatic images for the different color separations of one or more final toner images.

An additional primary imaging member can be incorporated into an apparatus of this invention for the application, either imagewise or non-imagewise, of the non-marking toner particles to the ITM.

The apparatus of this invention can have any known means for establishing imagewise electrostatic charge on the primary imaging member(s). The most preferred means is to use a corona or roller charger to deposit a uniform electrostatic charge on primary imaging member(s), preferably photoconductive imaging member(s), and then to expose the photoconductive imaging member(s) to light from one or more exposing devices which reduces some of the charge on the photoconductive imaging member(s) to create an imagewise charge also referred to as an electrostatic image, sometimes referred to as an electrostatic latent image, on the photoconductive imaging member(s).

The apparatus of this invention has at least one development station for marking toner particles, also referred to as a "marking development station". An apparatus having one marking development station produces single color toner final images. An apparatus having one marking development station produces single color toner final images. An apparatus with multiple marking development stations for different color marking toners can be used to produce single color or multi-color final toner images. It is preferred that each marking development station has the capacity to create a voltage difference between the marking development station and the imaging member so that marking toner particles are urged to transfer from the marking development station and electrostatically adhere to the imaging member to form a toned electrostatic image on the imaging member.

Preferably, the apparatus has a development station for non-marking toner particles, referred to as a "non-marking development station". It is preferred that the non-marking development station has the capacity to create a voltage difference between the non-marking development station and the imaging member so that non-marking toner particles are urged to transfer from the non-marking development station to the imaging member or ITM.

Various techniques for depositing both the marking and the non-marking toners from marking and non-marking development stations preferably bias development stations to a member may be used. Examples include contact deposition, such as by using a magnetic brush, or non-contact deposition, such as by projection toning and power cloud development.

The apparatus and method of this invention is useful for suppressing or reducing electrostatic transfer-induced image defects in high quality color electrophotography. In the main embodiments, a marking toner color image resting on a non-marking or clear toner layer is radiantly sintered at a sintering station prior to transfer of the toner image, from a primary imaging member or from an ITM, to a receiver such as paper. The radiation is selectively absorbed by the color toner, and is preferably not absorbed by the clear toner. The amount of radiation is sufficient to cause localized fusing of contact points between colored particles, but insufficient to significantly melt the clear toner. The amount of heat conducted to the interfaces between clear toner particles and the supporting member in the time between exposure to sintering radiation and transfer to a receiver is insufficient to significantly increase the adhesion between the clear toner and the supporting member (i.e., imaging member or ITM.). On the other hand, sintering between marking toner particles and clear toner particles may be permitted to occur to some extent, though preferably to a much lesser extent than between marking particles, in order to minimize the possibility of heat transfer to the interface between the supporting member and the clear toner.

In a typical color image comprising black, cyan, magenta and yellow toners, the sintering radiation typically contains wavelengths strongly absorbed by toners of each color. Moreover, the spectral balance of this radiation may be adjusted to optimize the degree of sintering when the different kinds of marking particles have different optical absorbencies. The spectral balance of the sintering radiation may also be adjusted to compensate for the stacking order of different color toners in a multicolor stack if the absorption spectra of different marking toners overlap significantly. If toner colors other than black, cyan, magenta and yellow are used, the spectral composition of the sintering radiation can be adapted to obtain the desired degree of sintering throughout a multicolor stack.

In a first mode of the apparatus and method of the invention illustrated in the copier and/or printer apparatus 10 of FIG. 1, sintering is done prior to transfer of toner from an intermediate transfer member (ITM), which is preferably a roller or drum, to a receiver R such as paper. A non-imagewise clear toner layer is bias-developed on to the ITM 30. A first monocolor toner image corresponding to one of the marking toners is transferred to the ITM (on top of the clear toner) from a primary imaging member 12, which may be a roller or a web but is preferably a roller. Subsequently, a second monocolor toner image corresponding to another of the marking toners is transferred to the ITM (on top of and in registration with the first toner image) and so forth until a completed multicolor image stack has been transferred on top of the clear toner on the ITM. The ITM roller 30 is then rotated to a sintering exposure station 38, where the sintering radiation is turned on to sinter the toner image for a predetermined length of time. The spectral composition and intensity of the spectral components of this radiation are preferably chosen to have sharp absorption maxim in the toners, such that each of the marking toners selectively absorbs a narrow band of radiation not absorbed by the other marking toners. Different light sources may be optically combined to produce the sintering radiation. Conversely, a broad-band sintering radiation may be employed when each of the color toners has a narrow-band absorption spectrum which does not overlap the absorption spectra of the others. A small amount of overlap of the absorption bands of different toners is allowable, but not to such a degree as to prevent radiation that needs to penetrate into the toner stack from being absorbed by particles near the surface of the stack. In this way, a uniform heating of the stack, and hence a uniform degree of sintering throughout the stack, can be effected. The clear toner layer is preferably completely transparent to all of the spectral components of the sintering radiation, although weak absorptions that cause negligible heating are allowed. After leaving the sintering station, the entire image stack of toner is moved by the rotating ITM to a final transfer station, where the sintered toner mass and at least a portion of the clear toner are electrostatically co-transferred at a transfer nip 52 to the receiver R, such as paper, and subsequently fused. The sintering operation in combination with the clear toner on the ITM assures that extremely high transfer efficiency is obtained for all the color toners at all densities. The ITM 30 is cleaned of any residual clear toner at a cleaning station 48 before another image is transferred to the ITM from the primary imaging member 12. The cleaning station 48 includes, for example, a brush or skive blade that is movable into and out of engagement with the surface of ITM 30 at appropriate times in accordance with control signals provided by a logic and control unit (LCU) which includes one or more computers and input/output devices that control various operations as is well known in the copier/printer arts.

The primary imaging member 12 is preferably an electrophotoconductive member. A primary charger such as a corona charger 24 or other charge source provides a uniform electrostatic charge to the surface of member 12. An exposure source 26, either a laser or LED printhead or other spatial light modulator, or an optical exposure source imagewise modulates light to form a latent or electrostatic image on the surface of member 12. Where the apparatus is a four color "process" color printer, toner in the development stations 14, 16, 18 and 20 is preferably black, cyan, magenta and yellow, respectively. The toner particles are preferably relatively small and have a particle size of between 2 $\mu$m and 9 $\mu$m. Each development station is preferably a dry, i.e. non-liquid, and also preferably a two component development station using insulative toner particles and hard magnetic carrier particles, and of the "SPD type" which is described for example in an article by Edward T. Miskinis, entitled "Designing Materials For the KODAK COLOREDGE Copier Program published in IS&T's Sixth International Congress on Advances in Non-Impact Printing Technologies", Pages 101–110. However, other types of dry development may be used including single component development stations.

Prior to or during formation of a first color separation image for the black color exposure, there is developed on the ITM 30 a clear toner layer which covers completely the active image carrying area of the ITM. The clear toner is provided in a non-marking development station 39. The non-marking development station 39 electrostatically charges the toner such as by tribocharging the insulative clear toner particles through rubbing with the carrier particles as is well known. An electrical bias is applied to the clear or non-marking development station 39 if needed for bias development. In the various embodiments described herein, the clear toner may be deposited by other types of apparatus and methods, besides dry toner bias development, for laying down a uniform layer of clear toner including depositing the toner from a liquid developer or powder deposited by means known in the art such as spraying, dusting, adhering, etc.

The intermediate transfer member ITM 30 comprises a conductive roller 32 biased by power supply 36 and coated with one or more elastomeric layers 34, and the electrical potential provided by power supply 36 is typically of a magnitude and of a polarity suited for transfer of the toner particles to a receiver sheet. The compliant layer 34 is greater than 1 mm in thickness and typically up to about 20 mm in thickness; preferably, it is between about 2 mm and about 15 mm in thickness. The Young's modulus of the material forming the compliant layer is greater than 0.1 MPa and less than about 10 MPa. Preferably, the Young's modulus is between about 1 MPa and about 5 MPa. A thin hard overcoat layer is preferably provided about the compliant blanket layer. The hard overcoat is formed of a material having a Young's modulus greater than that of the compliant blanket layer and is preferably greater than 100 MPa. The thickness of the hard overcoat layer is preferably between 2 $\mu$m and 30 $\mu$m. If roller 32 is nonconductive, a conductive layer (not shown) is coated under layer(s) 34 and connected to power supply 36. When the intermediate transfer member 30 is compliant, layer 34 may be, for example, a compliant, electrically semiconducting (resistivity of $10^6$ to $10^{12}$ ohm-cm) blanket.

The clear toner layer is preferably applied to the surface of the ITM 30 in a uniform layer or layers for example as monolayers. As the clear toner layer passes nip 50 between the ITM 30 and the primary imaging member 12, the electrical bias established by power supply 38 onto drum 32 attracts a toner image developed from say the first developed color separation image (for example black) formed on the primary image forming member 12. Each color separation image is formed, as is well known, by establishing a uniform primary electrostatic charge on the surface of primary imaging member 12 by operating primary charger 24. The primary electrostatic charge is then imagewise modulated by light from the exposure source 26 in response to image data for each color separation page that controls light from exposure source 26. The black color separation image is developed with black toner from marking development station or toner station 14 using bias development. The black toner separation image is then electrostatically transferred onto the clear toner layer at nip 50 under the electrical bias provided by power supply 36. The primary imaging member 12 is then cleaned at cleaning station 22. A uniform electrostatic charge is then provided by charger 24. A cyan color separation image is then formed by imagewise exposure of the uniformly charged primary imaging member and developed using bias development at marking development station 16. The cyan toner image is then transferred to the ITM at nip 50 in superposed registered relationship with the black toner image on the ITM. The magenta and yellow color separation toner images are then similarly respectively formed through the respective similar process of cleaning the primary image member, uniformly charging the image member, exposing the respective color separation images, and bias developing the respective color separation images with respective colored toner particles and transferring the respective toner images in registered superposed relationship to the ITM so that up to four color separation images exist in superposed registered relationship upon the ITM and overlie the clear toner layer. The color toner images as listed above are sintered at sintering station 38 and then transferred with the clear toner layer to receiver sheet R. Receiver sheet R is fed in suitable timed relationship, as is well known, from a supply 47 of receiver sheets. A logic and control unit (LCU), as is also well known, controls timing of the various components including a motor M which drives one or more of the mechanically driven members through suitable drive members not shown but selectable from those well known in the art. A transfer backing roller or member 40 is spring biased to apply pressure to the receiver sheet R in transfer nip 52. The transfer backing roller 40 may comprise a conductive drum and an optional compliant blanket layer coating overlying the conductive drum. The conductive drum of the backing roller 40 is biased to a suitable potential (500–5000 volts) provided by power supply 42. The polarity of the power supply 42 is opposite to the polarity of the toner particle image on the ITM, so that the electric field in the transfer nip urges the clear toner layer and the multicolor toner image on the ITM to transfer to receiver sheet R. The receiver sheet R, after transfer of the clear toner layer and the multicolor image thereto, is transported upon a belt 44 or other sheet conveyor to a fuser station 46 where the multicolor image is fixed by applying heat and pressure which causes the clear and colored toners to melt and adhere to the receiver sheet R. Thereafter, the cleaning member of cleaning station 48 engages the ITM to clean the surface thereof so that the next layer of clear toner may be deposited thereon for the next image.

In a first modification of the first mode, individual sinterings by sintering station 38 are carried out after transfer of each marking toner image to the ITM. Thus, after a first monocolor toner image corresponding to one of the marking toners is transferred to the ITM (on top of the clear toner) from the imaging member 12 at the transfer nip, it is sintered with a first sintering radiation at the sintering station. The same procedure is done for each subsequent toner image, with a second sintering radiation by sintering station 38 for the second marking toner image, and so forth until the entire stack of marking toner images has been sintered on the ITM, whereupon the sintered toner stack is moved to the final transfer station, followed by co-transfer of both clear and marking toners to the receiver R at transfer nip 52.

Figure 2:
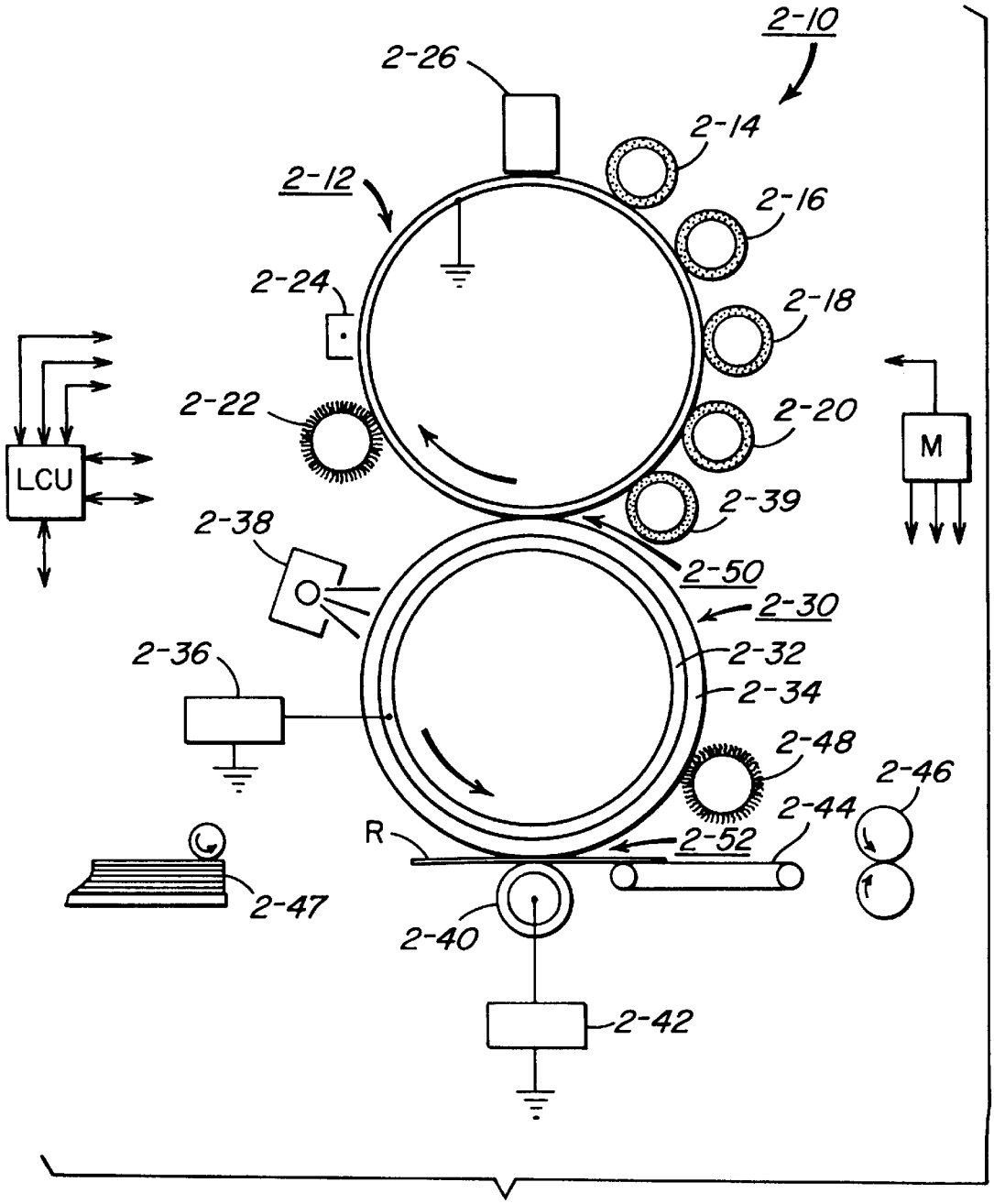
FIG. 2 is a similar view also in schematic form of an electrophotographic recording apparatus according to the invention that is similar to that of FIG. 1 but including a modification in location of a clear toner station.

With reference to FIG. 2, there is illustrated a second modification of the first mode. In the apparatus 2-10 of FIG. 2, members similar to that described with reference to FIG. 1 are identified with the same number but with a 2 in front. In this second modification, the primary imaging member 2-12 is charged, imagewise exposed with a first imaging photoexposure corresponding to a color separation for a first marking toner, and the resulting first latent image is developed with a first pigmented toner by the first marking development station 2-14. A clear toner layer (non-imagewise) is then bias-developed by non-marking development station 2-39 on top of the first color marking layer, and then both the clear toner plus the first marking toner are co-transferred to the ITM 2-30. The remaining steps of the first embodiment are the same except that a clear toner layer is deposited over each marking color image and transferred to the ITM. The plural toner color images and clear toner layers are built up as layers on ITM 2-30 and then transferred to receiver sheet R as described for the first mode of FIG. 1.

In a third modification of the first mode, the procedure of the second modification of the first mode, which is described above with reference to FIG. 2, is carried out, but with additional steps in which a sintering exposure is given after each transfer of color toner to the ITM (as done in the first modification of the first mode).

In a fourth modification of the first mode and with reference to FIG. 2, a clear toner image may be formed first on the primary imaging member 2-12 and transferred to the ITM 2-30. Thereafter, each marking color image may be formed on the primary imaging member and serially transferred in registered superposition to the ITM. The plural toner color images and clear toner layer are then transferred to receiver sheet R as described for the first mode of FIG. 1. After transfer of a respective marking color image to the ITM, the respective marking color image or layer may be sintered before depositing the next respective marking color image or layer. Alternatively, sintering exposure of all or plural marking color image layers may be made through one sintering exposure as described for the first mode of the apparatus and method of the invention.

Figure 3:
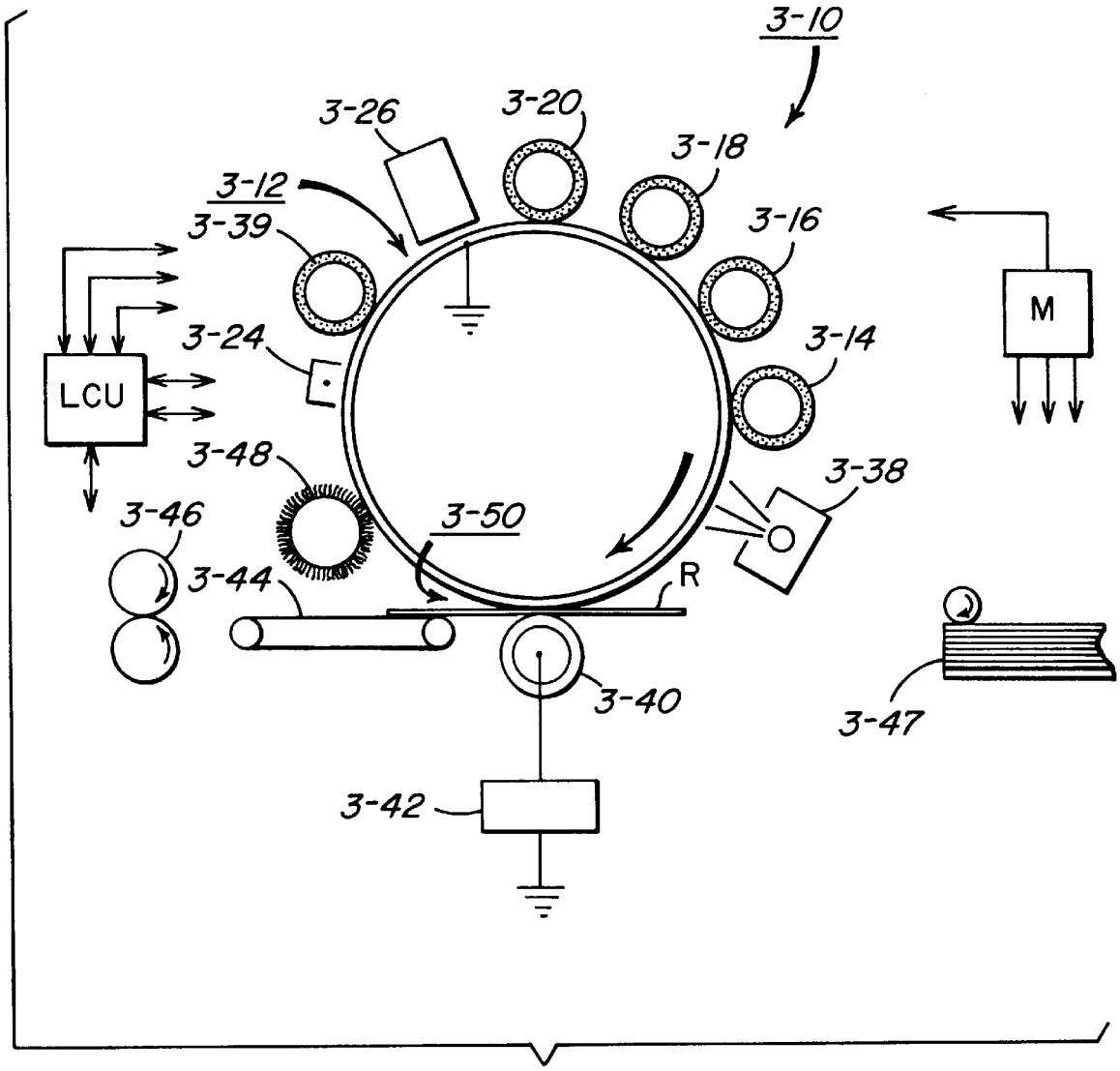
FIG. 3 is a side elevation view in schematic form of an electrophotographic recording apparatus in accordance with the invention and illustrating direct transfer to receiver sheet.

With reference to FIG. 3, a second mode of the apparatus and method of the invention is illustrated. The various stations and components that are similar to that described with reference to FIG. 1 are identified with the same number but preceded with a number 3. In the embodiment of FIG. 3, the ITM is eliminated and a direct transfer mode is used in which clear toner from a non-marking development station 3-39 is bias-developed (non-imagewise) onto a uniformly charged primary imaging member 3-12 prior to imaging. The uniform charge is provided by charger 3-24. A first imagewise photoexposure corresponding to a color separation for a first marking toner is provided at exposure station 3-26. The resulting first latent color separation image is developed with the first marking toner from marking development station 3-14. After a second uniform charging is made by charger 3-12, the imaging member 3-12 is imagewise exposed at exposure station 3-26 with a second color-separation photoexposure, to which the first marking color toner is transparent, corresponding to a color separation for a second marking color toner, and the resulting second latent image developed with the second marking toner at marking development station 3-16. This procedure is continued until a complete color stack of all marking toners has been created on the image member, such that the imaging photoexposure for each successive color separation is not significantly absorbed by previously developed marking toners or the respective color separation exposures are made at different respective pixel locations that are non-overlapping when the colored toner images are combined. Alternatively, the exposure station may be internal to the imaging member 3-12 wherein the primary imaging member or the support forming a part thereof is transparent to the light from the exposure station to allow exposure of the photoconductive layer on the primary imaging member to be imagewise exposed to each color separation image without interference by the marking toner layers on the primary imaging member. The primary imaging member bearing the complete image is advanced to a sintering station 3-38, where a selective sintering radiation exposure not absorbed by the clear toner layer is given, sintering the color toner layers, preferably uniformly. Any of the sintering radiation transmitted to and absorbed by the image member is insufficient to adversely affect its electrical state or its electrical properties in subsequent operations. Following sintering, the imaging member is advanced to a transfer station, where the sintered mass of marking toner plus the underlying clear toner are electrostatically co-transferred, under urging of an electrostatic field established by power supply 3-40 on transfer backing roller 3-40, to a receiver sheet R that is moved into transfer nip 3-50. The receiver sheet R is supplied from a source of receiver sheets 3-47 and is moved by belt 3-44 or conveyor to fuser 3-46 where the clear toner and colored toner images are fixed to the receiver sheet. In the embodiment of FIG. 3, the cleaning station 3-22 has its cleaning brush moved out of contact with the primary imaging member 3-12 until after transfer of the multicolor image to the receiver sheet R. Then the cleaning brush (or blade) is brought into engagement with the imaging member 3-12 to remove any untransferred toner. The process repeats for the creation of the next multicolor image. In this second mode, the charge on the clear toner and the charge provided by the primary charging station 3-24 provide the primary charge for forming the first pigmented toner image layer. For the other color pigmented toner image layers the output of the primary charging station is adjusted accordingly since no additional layer of clear toner is provided before exposing and developing these other pigmented toner image layers.

A first modification of the second mode of FIG. 3 is to use the bias-development of the clear toner as a means of uniformly charging the image member prior to the imaging photoexposure for the first latent image. This can be used to eliminate the need for the primary charger 3-24 since the clear toner is applied uniformly with a charge on the clear toner particles.

A second modification of the second mode involves a selective sintering exposure after each color separation latent image has been developed with a corresponding marking toner, rather than one sintering exposure. This helps to prevent scavenging of a previously deposited marking toner when a subsequent marking toner is developed.

A third modification of the second mode is to position the non-marking development station 3-39 after the imaging exposure station 3-26. This allows the non-marking or clear toner to be developed on the primary imaging member 3-12 only at locations where multiple layers of color marking toners will be subsequently developed instead of providing a uniform deposit of clear toner over an entire image frame of the primary imaging member.

A fourth modification of the second mode is to position the non-marking toner station before the primary charging station.

Figure 4:
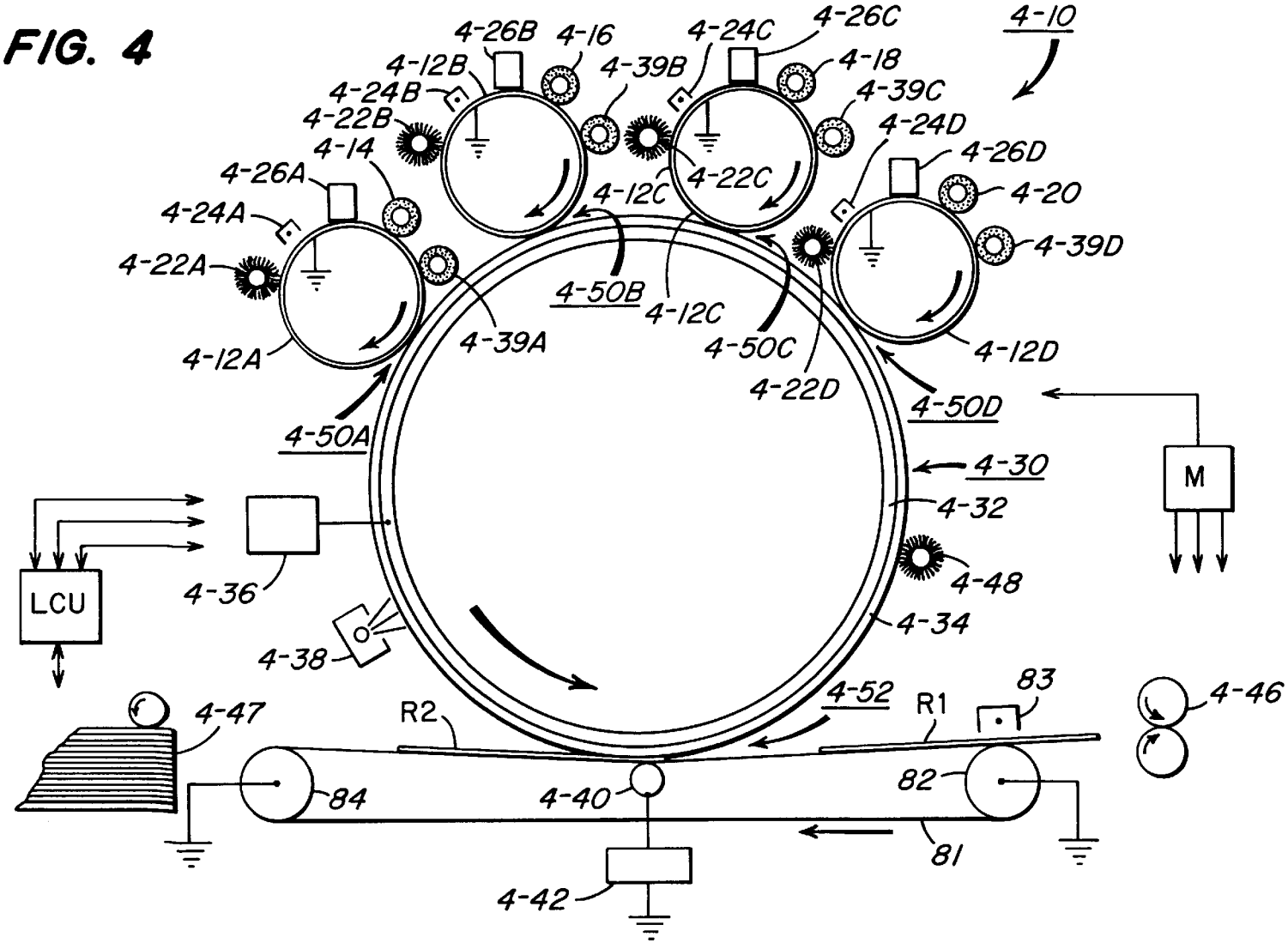
FIG. 4 is a side elevation view in schematic form of an electrophotographic recording apparatus and illustrating another exemplary embodiment of the invention.

With reference now to FIG. 4, a third mode of the apparatus and method of the invention is illustrated. In the third mode, each color separation toner image is successively co-transferred with a clear toner layer from a respective primary imaging member to an ITM. In the apparatus 4-10 of FIG. 4, members or components similar to that described with reference to FIG. 1 are identified with the same number but with a 4 preceding same. Also, in the apparatus 4-10, plural primary imaging members 4-12A, 4-12B, 4-12C and 4-12D are provided for forming different respective color toner images. As the stations about the respective imaging members are substantially similar they are distinguished by the respective letter A, B, C and D. Considering as an example primary imaging member 4-12A, the respective surrounding stations are a cleaning station 4-22A, a primary charging station 4-24A, an image exposure source 4-26A, a clear toner non-marking development station 4-22A and a marking development station 4-14. Description relative to the other color stations need not be made since they are similar to that to be described. In this mode, a uniform charge is formed on a primary imaging member, for example 4-12A by primary charging station 4-24A. The uniformly charged primary imaging member 4-12A is then given a first imagewise photoexposure corresponding to a first color separation by exposure source 4-26A. The latent electrostatic image formed on the primary imaging member 4-12A is then developed by a first marking toner of a first color corresponding to the color separation record to form a first marking toner image. A clear toner layer is then bias-developed on top of the first marking toner image by non-marking development station 4-39A, and then the clear toner and first marking toner image are co-transferred to the ITM 4-30. This step is repeated for each color marking toner image by respective stations, with each transfer to the ITM in registry. The result is a sandwich structure having a clear toner layer adjacent to the surface of the ITM, and having alternate layers of clear toner and marking toner images. A sintering exposure is than given at a sintering station 4-38 prior to transfer of the whole toner mass to a receiver R2 at a transfer station, and subsequently fused at a fusing station 4-46.

In this embodiment, the receiver sheets are introduced into the transfer nip 4-52 between the transfer roller 4-40 and the ITM 4-30 by a transport support belt 81. The belt 81 is entrained about rollers 82, 84, one of which may be driven. A detack charger 83 may also be provided for reducing the adhesion of the receiver sheets (such as R1 shown) to the belt. Details regarding use of a transfer belt 81 are described in co-pending commonly assigned U.S. application Ser. No. 08/900,696 in the names of Tombs and Benwood, the pertinent contents of which are incorporated herein by reference.

Figure 5:
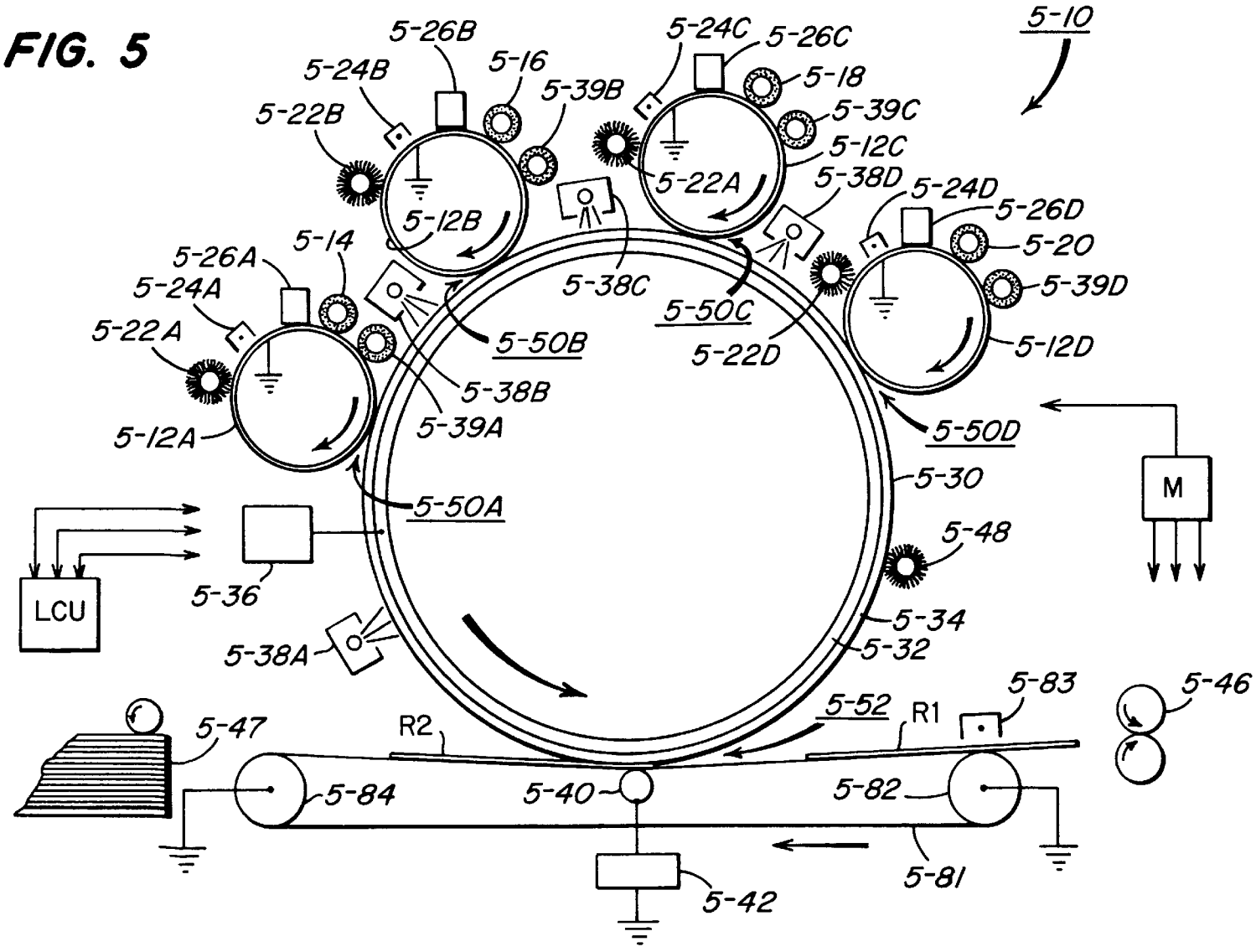
FIG. 5 is a similar view also in schematic form of an apparatus according to the invention and similar to that of FIG. 4 but modified to feature separate sintering stations.

With reference to FIG. 5, a first modification of the third mode is to sinter the toner deposit on the ITM 4-30 after each co-transfer of clear and marking toners. After the last sintering following the transfer of the last marking toner separation image to the ITM, the whole mass of toner is transferred from the ITM to a receiver at the transfer station, and subsequently fused.

In the embodiment of FIG. 5, similar structure to that described with reference to the embodiment of FIG. 4 are identified with the same number but with a 5 in front instead of a 4. The embodiment of FIG. 5 is similar in all respects to that of FIG. 4 except that the sintering exposure is provided by four separate sintering exposure stations 5-38A, B, C, and D, respectively, associated with a respective color image forming station but each situated about the periphery of the ITM. As each respective color separation image and clear toner layer is deposited on the ITM 5-30, the respective color marking toner image is sintered by the respective sintering exposure station.

Figure 6:
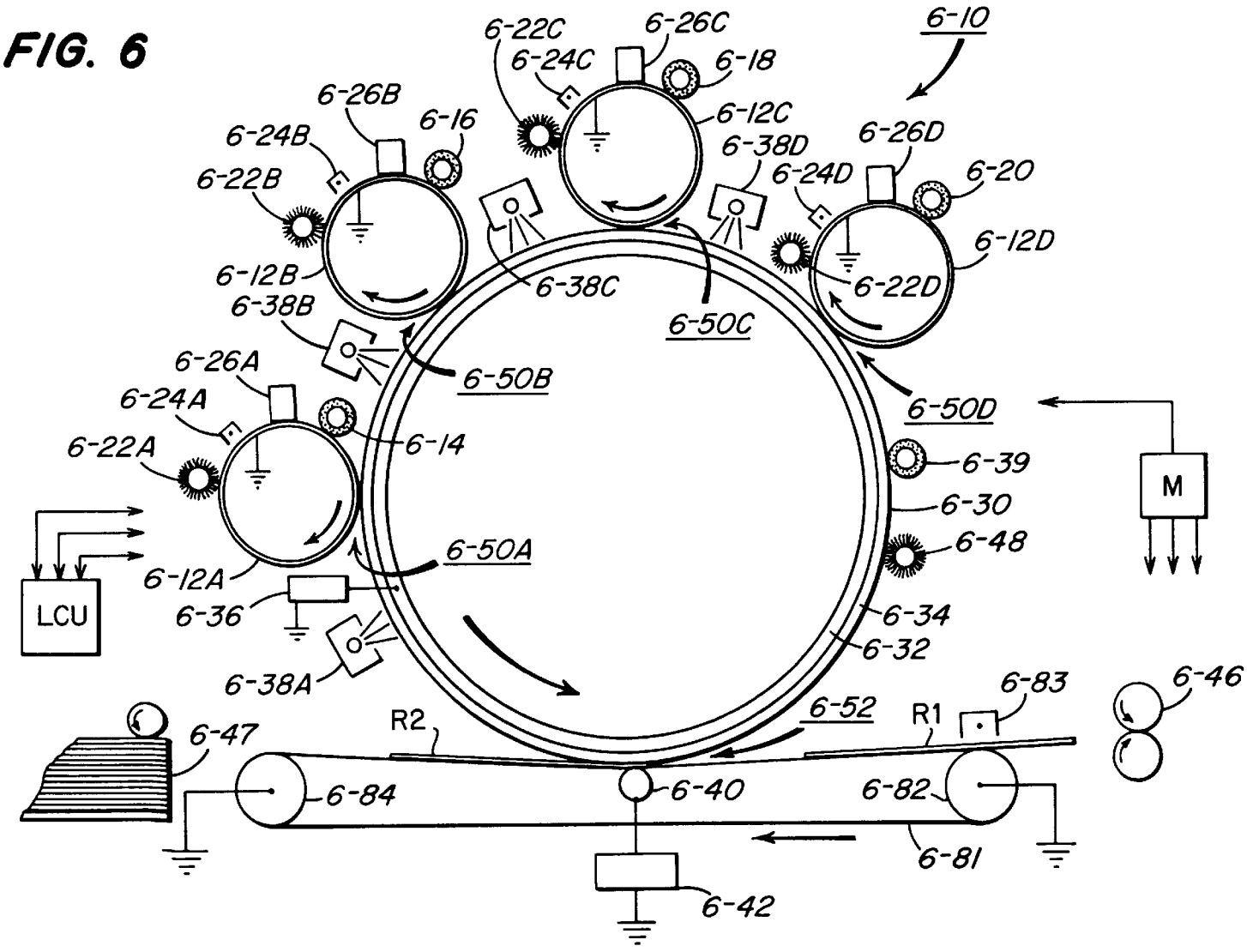
FIG. 6 is a similar view in schematic form of an apparatus according to the invention which is similar to that of FIG. 5 but modified to feature a single clear toner station located to develop a clear toner layer on the ITM.

In still another modification of the third mode of FIG. 4, there is shown in FIG. 6 an apparatus 6-10 similar in all respects to that of FIG. 5 except that only a single clear toner non-marking development station 6-39 is provided for depositing a uniform clear toner layer upon the ITM 6-30. Similar structure to that described with reference to FIGS. 4 and 5 are identified with the same number but with a 6 in front. In the embodiment of FIG. 6, a single clear toner layer is first formed on the ITM 6-30 and thereafter, each of the color separation images are deposited upon the ITM 6-30 in respective order; i.e., a first color separation image transferred from the first color primary imaging member 6-12D, then a second color separation image from the second color primary imaging member 6-12C, then a third color separation image from the third color primary imaging member 6-12B and, lastly, a fourth color separation image from the fourth color primary imaging member 6-12A. All the color separation images are transferred in registered relationship to the ITM 6-30 to form a single multicolor image. After each color separation image is transferred to the ITM 6-30, it is sintered by a respective sintering exposure station 6-38A, B, C, D, respectively. Thus, in this embodiment only one clear toner layer is provided for each multicolor image.

Figure 7:
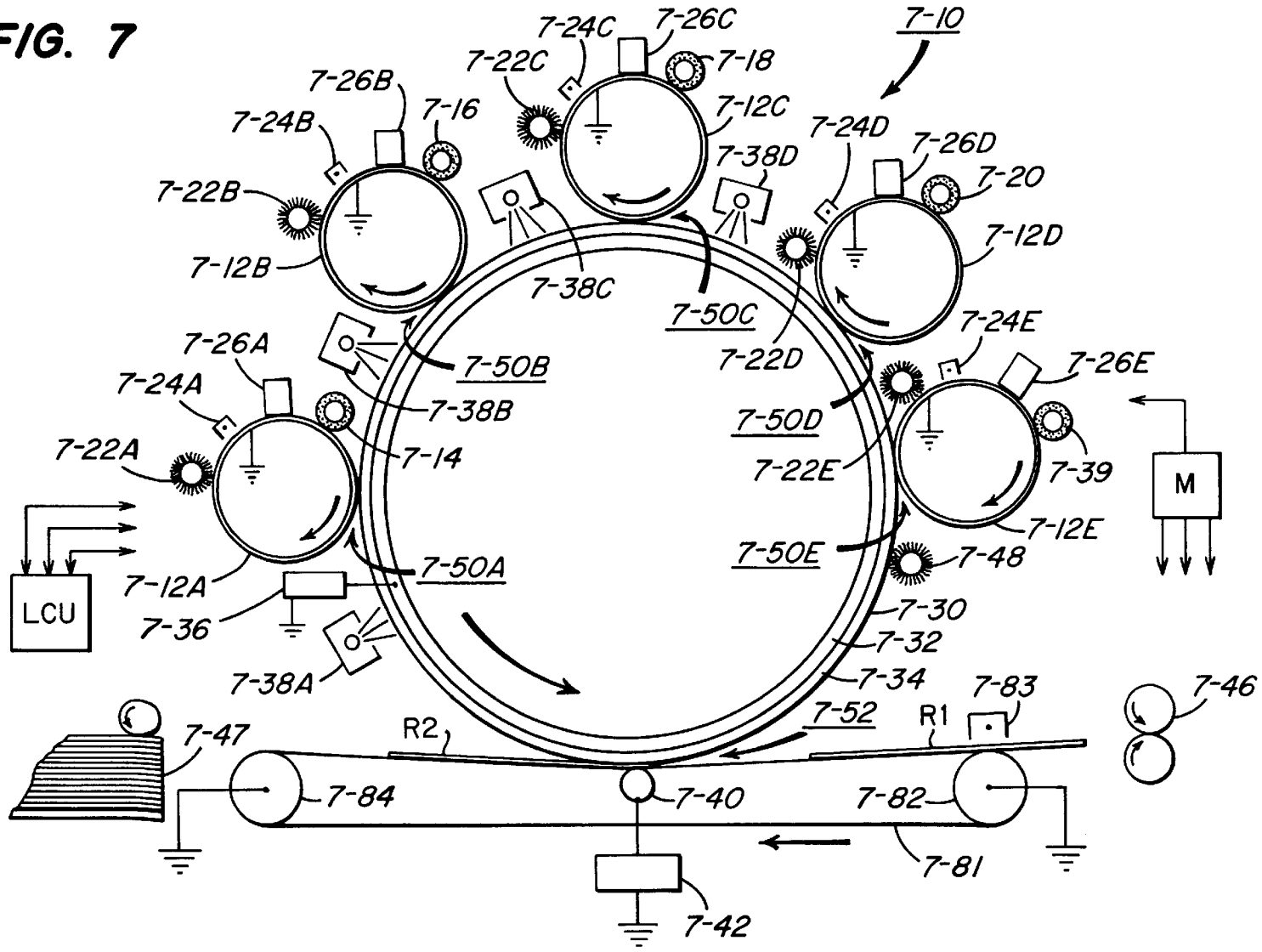
FIG. 7 is a similar view in schematic form of an apparatus according to the invention which is similar to that of FIG. 6 but modified to provide an additional primary imaging station to allow selective placement of toner.

In yet another modification of the third mode of FIG. 4, there is shown in FIG. 7 a particularly preferred embodiment of the apparatus and method of the invention. The embodiment of FIG. 7 is similar to that of FIG. 6 except that an additional photoconductive drum or roller (primary imaging member) 7-12E is added having a cleaning station 7-22E, a primary charging station 7-24, an imaging exposure station 7-26E and a non-marking (clear) toner station 7-39 located about the periphery of the roller 7-12E. The other structures associated with FIG. 6 and described therefor are identical with that shown in FIG. 7 and are identified with a number 7 in the front thereof. In the embodiment of FIG. 7, the non-marking development station 7-39 is not associated directly with the ITM 7-30 as in the embodiment of FIG. 6 but is instead associated directly with the new primary imaging station 7-12E. This allows for selective placement of clear toner in pictorial areas or areas where multiple colored toner image layers are built up on the ITM 7-34.

The operation of FIG. 7 is, with regard to the color imaging process, similar to that discussed with reference to FIG. 6 and those embodiments of the third mode. Specifically, a multicolor image is produced by depositing a uniform electrostatic charge on each of the primary imaging members for each color forming a part of the multicolor image, examples of which may be cyan, magenta, yellow and black. The primary charge on each of the primary imaging members 7-12A, B, C and D is imagewise modulated using a color separation image data record by imaging exposure station 7-26A, B, C and D, respectively. The respective color separation electrostatic images formed on the respective primary imaging members are developed with pigmented color toner particles from the respective marking development stations 7-14, 7-16, 7-18 and 7-20, respectively. The respective developed color separation images are transferred to the ITM from the respective primary imaging members in suitably timed relationship to build up the various color separation images in registered relationship corresponding to the multicolored image. If, as will be discussed in further detail below, the image to be produced includes both text and pictorial images it is preferred to facilitate transfer from the ITM to the receiver sheet R2 to provide clear toner in only the area on the ITM where the pictorial image is built up. This is desirable regarding pictorial images which typically have areas of low density and are more noticeably affected if transfer is not relatively complete. Text information is typically produced in maximum densities and their images suffer relatively less when transferred. In order to provide a selected area of an image with clear toner a primary charge is deposited on primary imaging member 7-12E and imagewise modulated by imaging exposure station 7-26E. In as much as the selected area exposure of primary imaging member 7-12E is preferably of the area of the pictorial image, the exposure station need not be of the same resolution of that for forming pixels by the imaging exposure stations used for forming pigmented toner images. The latter imaging exposure stations are typically of a resolution at or above 300 dots or pixels per inch and more preferably at or above 600 dpi. Thus, less expensive exposure sources such as an EL (electroluminescent) panel may be used or a lower resolution LED printhead or laser source. However, an exposure source of the same resolution as the LED printhead used for the imagewise exposure for developing the pigmented toner image is contemplated by our invention for selectively recording pixel areas to be developed with clear toner. After an imagewise exposure, which may be of low resolution, the electrostatic image on the primary imaging member 7-12E is developed in the selected area with clear toner by the non-marking development station 7-39. The developed clear toner layer on the primary imaging member is then electrostatically transferred to the ITM 7-30 at transfer nip 7-50E. This transfer is provided before the respective color marking images are transferred to the ITM so that the clear toner layer is beneath all of the marking layers. The respective color marking layers are then transferred in registered superposition at respective transfer nips 7-50D, 7-50C, 7-50B and 7-50A. With each respective transfer of a marking toner particle color separation image or color marking layer to the ITM, a sintering exposure of the respective toner color image or color marking layer is provided by respective sintering exposure stations 7-38D, 7-38C, 7-38B 7-38A. Alternatively, as noted above one sintering exposure may be simultaneously provided to all the color marking layers on the ITM. Thereafter, the multicolored image on the ITM is electrostatically transferred at transfer nip 7-52 to a receiver sheet R2 supported on a transport support belt 7-81. The multicolored image is then detacked from the belt 7-81 and fused in fuser rollers 7-46.

The invention is also useful in an electrostatographic recording apparatus wherein each monocolor toner image is formed upon a different respective primary imaging member (such as a photoconductor belt or roller) and then transferred to a separate respective intermediate transfer member. Thus, if four colors are provided for by this apparatus there may be four primary imaging members and four intermediate transfer members, each paired with a respective primary imaging member. A receiver sheet may be moved by a belt to receive in transfer each monocolor image as the receiver moves serially into transfer contact with each ITM. An example of such an apparatus is described in the aforementioned Tombs and Benwood application, the contents of which are incorporated by reference herein. Such an apparatus may be modified in accordance with the teachings herein by depositing of a clear toner layer upon each photoconductor after formation of the respective pigmented toner image thereon. Sintering of the pigmented toner image is provided for on the respective ITM. The respective clear toner layer(s) may alternatively be developed directly on each respective ITM before transfer of the respective pigmented toner image to each respective ITM.

Figure 8:
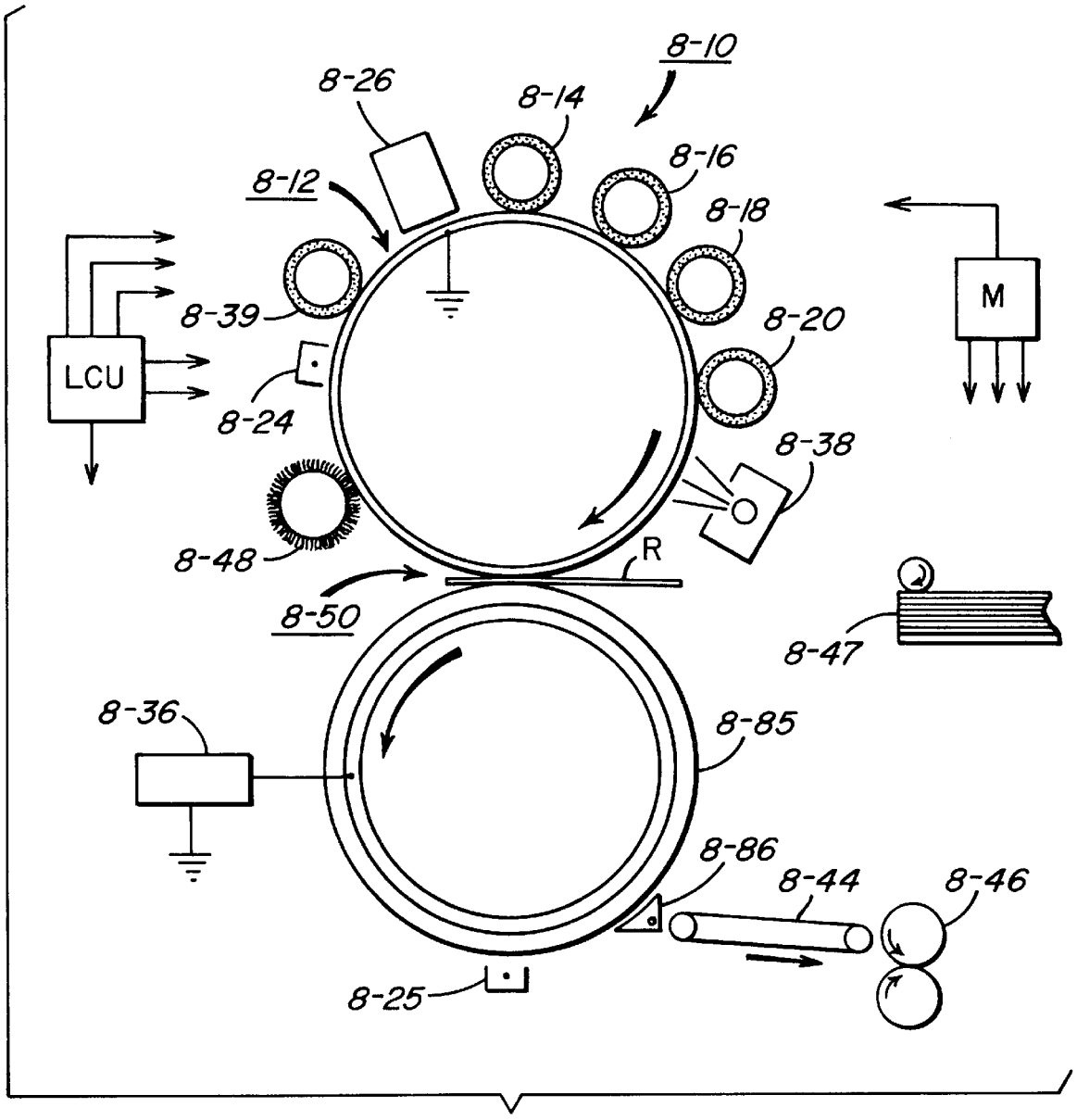
FIG. 8 is a side elevation view in schematic form of yet another embodiment of the invention.

With reference to FIG. 8, there is shown a fourth mode of the method and apparatus of the invention which is distinguished from the previous modes in that a receiver sheet R is carried on a rotating transfer belt or drum 8-85 for a series of revolutions wherein a different color pigmented toner image is transferred to the receiver sheet during each pass of the receiver at the transfer nip 8-50 between the primary imaging member and the transfer drum 8-85. In the embodiment of FIG. 8, a clear toner layer is applied to the primary imaging member 8-12 by the non-marking development station 8-39. The tribocharged toner of the clear toner particles may comprise the primary charge to the primary imaging member or be in combination with the charge from the primary charging station. The charged primary imaging member 8-12 is imagewise exposed at the imaging exposure station 8-26 with a light pattern representing the color image to be developed with pigmented color toner from marking development station 8-14. After exposure the electrostatic latent image is developed with pigmented toner from the marking development station 8-14. The developed pigmented toner image is then subjected to a sintering exposure at sintering station 8-38 to sinter the pigmented toner image and the pigmented toner image is then transferred to the receiver sheet R which has been advanced into the transfer nip 8-50 from supply 8-47. The receiver sheet R may be held upon the transfer drum 8-85 by electrostatic attraction provided by electrical bias provided to the transfer drum by power supply 8-36 which provides the electrical bias for electrostatic transfer of the pigmented color toner images to the receiver sheet. Additional means for holding the receiver sheet to the transfer drum are well known and include vacuum attraction to the drum and/or grippers for gripping of the leading and trailing edges of the receiver sheet when rotated on the drum. After the first pigmented color toner image and at least a portion of the clear toner are co-transferred to the receiver sheet R, the cleaning station 8-48 removes any remnant toner on the primary imaging member 8-12. The process repeats for recording the next pigmented color toner image which is made by charging, imagewise exposing and then developing with pigmented toner from marking development station 8-16 upon a clear toner layer that is deposited on the primary imaging member 8-12 subsequent to the noted cleaning step. The second pigmented color toner image is then sintered at sintering station 8-38 and at least a portion of the clear toner layer and the second pigmented color toner image are co-transferred at nip 8-50 to the receiver sheet which is continuously being rotated on transfer drum 8-85. After all of the pigmented toner images are similarly formed, sintered and transferred in registered superposition on the receiver sheet to form a multicolored image, a detack charger 8-25 is operated to detack the receiver sheet from the drum 8-85. The detack of the receiver sheet may further be assisted by a skive blade 8-86 which may be moved by a suitable mechanism into engagement with the drum 8-85 at a predetermined time to engage the lead edge and ensure separation of the receiver sheet R from the drum 8-85 as is well known. The receiver sheet R is then advanced by a transport belt 8-44, typically in this example a vacuum transport belt, to the fusing rollers 8-46 wherein the multicolored image is fixed to the receiver sheet. Since the toner image on the receiver sheet is unfixed, it is desirable to support the sheet on the surface opposite that of the toner image.

Still other modifications are possible according to the fourth mode. For example, the embodiment of FIG. 5 may be modified by having a transfer drum replace the ITM 5-30 so that a receiver sheet may be advanced onto the transfer drum and supported thereon as a transfer drum rotates. The receiver sheet serially passes transfer nips 5-50D, 5-50C, 5-50B and 5-50A and in each pass a co-transfer of a pigmented toner image layer and a clear toner layer is made to the receiver sheet to form a multicolor image. In this example, the pigmented toner image in each case is sintered while on the respective primary imaging member prior to transfer to the receiver sheet. The receiver sheet, after transfer of each of the respective pigmented toner images is transferred thereto in registered superposition, may be stripped from the transfer drum and advanced to the fusing rollers as described for the embodiment of FIG. 8. Thus, in this regard the belt structure illustrated in FIG. 6 for supporting the receiver sheet would not be used.

While the invention has been described with reference to color separation images, other types of color images such as accent color may also be produced and the apparatus may be operated in a single color mode. Also toners of the same color but different physical properties can be produced, for example, separate toner images of the same color but one being nonmagnetic while the other is magnetic may be combined in accordance with the above description of combining different color toner images.

In an embodiment wherein a clear (non-marking) toner layer is developed or otherwise first formed on a primary imaging member and a pigmented toner image is to be developed to form pictorial and textual information, the clear toner layer may be selectively deposited or formed in an area of an image frame corresponding to the location of the pictorial information. This may be accomplished by having an image processor analyze the image data for an image frame to determine if pictorial region(s) are present and to determine the border(s) of the pictorial information. Image processing circuits are well known for this type of analysis, some typically relying upon the image data for pictorial information having high frequency components. The image information representing the borders of the pictorial information may be used to create a bit map of the image area wherein data is provided for selectively actuating the imaging exposure station to expose a uniform electrostatic charge on the image frame of the primary imaging member selectively so that development of the clear toner layer selectively occurs at areas of the image frame corresponding to the pictorial information. Another approach is to provide a criterion for selective deposition of the clear toner layer where multiple colors would tend to overlap since this presents the greater difficulty in transfer. The image analyzer would then compare where pixel locations in the different color separation image records tended to overlap or were relatively closely located and provide for an image data record of the clear toner image. An imaging exposure station would record on an image frame pixel areas where clear toner is to be developed since it corresponds to areas where multiple colors will be formed in the image prior to transfer to a receiver sheet.

In the various embodiments described above, transfer is accomplished using electrostatic transfer. However, while this is preferred, it is also known to use an adhesive transfer for transferring toner from a primary imaging member to an ITM or to a receiver sheet and/or from the ITM to a receiver sheet.

The primary imaging member and the ITM may each be a web or drum. While the invention in the preferred embodiments describes forming an image on a primary imaging member that is a photoconductor, other types of electrostatographic recording are contemplated in the broader aspects of the invention. Thus, the primary imaging member may form electrostatic images using electrographic recording wherein charge is imagewise modulated and deposited on an electrographic recording medium using electrographic recording elements. The modulated charge is then developed with toner as described for recording using the electrophotoconductive processes described above.

In the various embodiments wherein different primary imaging members are provided in an embodiment, the various stations' positions and types may be optimized for best performance. In addition, different types of say a cleaning station, for example, may be associated with different primary imaging members; i.e., one imaging member may have a brush cleaner and another a blade cleaner or combination blade plus brush cleaner. Where desirable in the various embodiments described, the transport support roller or cleaner may be moved out of engagement with a member carrying an image for the periods when the function of the roller or cleaner is not needed. The illustrated examples are not shown to scale, particularly with regard to coatings in order to facilitate understanding of the invention.

Compared to the prior art, the combined use of clear toner and color-selective radiant sintering improves electrostatic transfer efficiencies, and gives improved image integrity by suppressing electrostatic image disruption during transfer. Another advantage is that sintering on the ITM or the primary imaging member also minimizes the likelihood of premature transfer from the ITM to the receiver sheet at locations prior to the transfer nip. As a result, image quality for color electrostatography can be improved significantly by preventing back-transfer, especially for very thick multicolor toner stacks, and reducing image grain on the receiver after transfer of thin toner stacks.

The invention has been described in detail with particular reference to certain preferred embodiments thereof, but it will be understood that variations and modifications can be effected within the spirit and scope of the invention.

PARTS LIST

Apparatus: 10; 2-10; 3-10; 4-10; 5-10; 6-10; 7-10; 8-10.

Primary Imaging Member: 12; 2-12; 3-12; 4-12A; 4-12B; 4-12C; 4-12D; 5-12A, 5-12B, 5-12C, 5-12D; 6-12A; 6-12B; 6-12C; 6-12D; 7-12A, 7-12B, 7-12C, 7-12D, 7-12E; 8-12.

Marking Development Station: 14, 16, 18, 20; 2-14, 2-16, 2-18, 2-20; 3-14, 3-16, 3-18, 3-20; 4-14, 4-16, 4-18, 4-20; 5-14, 5-16, 5-18, 5-20; 6-14, 6-16, 6-18, 6-20; 7-14, 7-16, 7-18, 7-20; 8-14, 8-16, 8-18, 8-20.

Cleaning Station: 22; 2-22; 3-22; 4-22A, 4-22B, 4-22C, 4-22D; 5-22A, 5-22B, 5-22C, 5-22D; 6-22A, 6-22B, 6-22C, 6-22D; 7-22A, 7-22B, 7-22C, 7-22D.

Primary Charging Station: 24; 2-24; 3-24; 4-24A, 4-24B, 4-24C, 4-24D; 5-24A, 5-24B, 5-24C, 5-24D; 6-24A, 6-24B, 6-24C, 6-24D; 7-24A, 7-24B, 7-24C, 7-24D, 7-24E; 8-24.

Imaging Exposure Station: 26; 2-26; 3-26; 4-26A, 4-26B, 4-26C, 4-26D; 5-26A, 5-26B, 5-26C, 5-26D; 6-26A, 6-26B; 6-26C; 6-26D; 7-26A, 7-26B, 7-26C, 7-26D, 7-26E; 8-26; 8-26.

Intermediate Transfer Member (ITM): 30; 2-30; 4-30; 5-30; 6-30; 7-30.

ITM Roller: 32; 2-32; 4-32; 5-32; 6-32; 7-32.

Compliant Layer or Blanket: 34, 2-34; 4-34; 5-34; 6-34; 7-34.

Power Supply: 36; 2-36; 4-36; 5-36; 6-36; 7-36; 8-36.

Sintering Exposure Station: 38; 2-38; 3-38; 4-38; 5-38A, 5-38B, 5-38C, 5-38D 6-38A, 6-38B, 6-38C, 6-38D; 7-38A, 7-38B, 7-38C, 7-38D; 8-38.

Non-marking Development Station: 39; 2-39; 3-39; 4-39A, 4-39B, 4-39C, 4-39D; 5-39A, 5-39B, 5-39C, 5-39D; 6-39; 7-39; 8-39.

Transfer Support Roller: 40; 2-40; 3-40; 4-40; 5-40; 6-40; 7-40.

Power Supply: 42; 2-42; 3-42; 4-42; 5-42; 6-42; 7-42.

Transport Belt: 44; 2-44; 3-44; 8-44.

Fusing Rollers: 46; 2-46; 346; 4-46; 5-46; 6-46; 7-46; 8-46.

Supply of Receiver Sheets: 47; 2-47; 3-47; 4-47; 5-47; 6-47; 7-47; 8-47.

Cleaning Station: 48; 2-48; 4-48; 5-48; 6-48; 7-48; 8-48.

Transfer Nip: 50, 52; 2-50, 2-52; 3-50; 4-50A, 4-50B, 4-50C, 4-50D, 4-52; 5-50A, 5-50B, 5-50C, 5-50D, 5-52; 6-50A, 6-50B, 6-50C, 6-50D, 6-52; 7-50A, 7-50B, 7-50C, 7-50D, 7-50E, 7-52; 8-50.

Transfer Support Belt: 81; 5-81; 6-81; 7-81.

Rollers: 82, 84; 5-82, 5-84; 6-82, 6-84.

Detack Charger: 83; 5-83; 6-83; 7-83; 8-25.

Transfer Drum: 8-85.

Skive Blade: 8-86.

What is claimed is:

1. A method of forming a toner image on a receiver sheet, the method comprising:

applying a clear toner layer to a support member;

applying a pigmented dry toner image comprising a mass of pigmented toner particles over the clear toner layer;

sintering the pigmented toner image so that the mass of pigmented toner particles is heated to a temperature which causes contact points between the pigmented toner particles to fuse but actual melting of whole particles does not occur and individual pigmented toner particles retain physical integrity as well as charge integrity and material bridges between pigmented toner particles produced by the sintering enhance inter-particle cohesion; and transferring the sintered pigmented toner image to the receiver sheet.

2. The method of claim 1 and wherein the pigmented toner image is a multicolored image.

3. The method of claim 2 wherein the multicolored image is built up by serially depositing plural different color monocolor toner images upon the support member in registration with each other to form the multicolor image.

4. The method of claim 3 wherein the step of sintering is performed in plural sub-steps so that a first monocolor image of a first color is subject to a sintering sub-step before a second monocolor image of a second color is placed over the first monocolor image.

5. The method of claim 4 wherein the support member is an intermediate transfer member and the monocolor toner images are formed on a primary imaging member and serially transferred to the intermediate transfer member.

6. The method of claim 5 wherein the clear toner layer is applied to the support member by application of toner from a development station.

7. The method of claim 5 wherein the clear toner layer is formed on the primary imaging member and transferred to the intermediate transfer member.

8. The method of claim 3 wherein the step of sintering is performed on the multicolored image.

9. The method of claim 8 wherein the support member is an intermediate transfer member and the monocolor toner images are formed on a primary imaging member and serially transferred to the intermediate transfer member.

10. The method of claim 9 wherein the clear toner layer is applied to the support member by application of toner from a development station.

11. The method of claim 9 wherein the clear toner layer is formed on the primary imaging member and transferred to the intermediate transfer member.

12. The method of claim 3 wherein the support member is a primary imaging member wherein an electrostatic image is developed with pigmented toner to form the pigmented toner image.

13. The method of claim 3 wherein the support member is an intermediate transfer member and the monocolor toner images are formed on respective different primary imaging members and serially transferred to the intermediate transfer member.

14. The method of claim 13 and wherein the clear toner layer is developed upon at least one of the primary imaging members before being transferred to the intermediate transfer member.

15. The method of claim 14 wherein a clear toner layer is formed on each of plural primary imaging members and transferred to the intermediate transfer member with a respective pigmented toner image and respective pigmented toner images are sintered before being combined with a different color pigmented toner image.

16. The method of claim 15 wherein an electrostatic image is formed in a primary charge created by a layer of electrostatically charged clear toner.

17. The method of claim 1 wherein the support member is an intermediate transfer member and the clear toner layer is formed on a primary imaging member and transferred to the intermediate transfer member.

18. The method of claim 17 wherein a first pigmented toner image is formed on the primary imaging member before the clear toner layer is formed on the primary imaging member and the first pigmented toner image and the clear toner layer are transferred to the intermediate transfer member before said step of applying a pigmented toner image over the clear toner layer which forms a second pigmented toner image on the intermediate transfer member.

19. The method of claim 1 wherein the support member is an intermediate transfer member and, in the step of applying a clear toner layer to a support member, the clear toner layer is first formed on the intermediate transfer member.

20. The method of claim 1 wherein the clear toner layer is transferred from the support member to an intermediate transfer member and the pigmented toner image is applied over the clear toner layer when the clear toner layer is located on the intermediate transfer member.

21. The method of claim 1 wherein the clear toner layer is formed selectively to be beneath some portion of an image and not beneath another portion of the image.

22. The method of claim 1 wherein a portion of the clear toner layer is transferred with the sintered pigmented toner image to the receiver sheet.

23. The method of claim 1 and including, after transferring the sintered pigmented toner image to the receiver sheet, fusing the sintered pigmented toner image to the receiver sheet.

24. The method of claim 1 and wherein the pigmented toner image is applied over the clear toner layer by electrostatically attracting pigmented toner.

25. An apparatus for forming a toner image upon a receiver sheet, the apparatus comprising:

a support member;

a development station for depositing a layer of clear toner upon the support member;

a development station for depositing a pigmented dry toner image comprising a mass of pigmented toner particles over the clear toner layer;

a sintering device for sintering the pigmented toner image so that the mass of pigmented toner particles is heated to a temperature which causes contact points between the pigmented toner particles to fuse but actual melting of whole particles does not occur and individual pigmented toner particles retain physical integrity as well as charge integrity and material bridges between pigmented toner particles produced by the sintering enhance inter-particle cohesion; and a transfer station for transferring the sintered pigmented toner image to the receiver sheet; and a fusing station separate from the transfer station for fusing the pigmented toner image to the receiver sheet.

* * * * *